US005401620A

United States Patent [19]

Sasai et al.

[11] Patent Number: 5,401,620

[45] Date of Patent: Mar. 28, 1995

[54] SILVER HALIDE PHOTOGRAPHIC MATERIAL FOR LASER EXPOSURE

[75] Inventors: Masahide Sasai, Shizuoka; Naoki Arai, Kanagawa, both of Japan

[73] Assignee: Fuji Photo Film Co., Ltd., Kanagawa, Japan

[21] Appl. No.: 33,344

[22] Filed: Mar. 18, 1993

[30] Foreign Application Priority Data

Mar. 19, 1992 [JP] Japan ..... 4-063314
Apr. 28, 1992 [JP] Japan ..... 4-109832

[51] Int. Cl.[6] ..... G03C 7/00; G03C 1/06; G03C 1/08; G03C 1/815

[52] U.S. Cl. ..... 430/363; 430/508; 430/510; 430/513; 430/517; 430/522

[58] Field of Search ..... 430/363, 944, 945, 510, 430/513, 508, 517, 522, 963

[56] References Cited

U.S. PATENT DOCUMENTS

| | | | |
|---|---|---|---|
| 2,274,782 | 3/1942 | Gaspar | 430/510 |
| 2,461,484 | 2/1949 | Thompson | 430/522 |
| 2,527,583 | 10/1950 | Silberstein et al. | 430/507 |
| 3,384,487 | 5/1968 | Heseltine et al. | 430/507 |
| 3,423,207 | 1/1969 | Heseltine et al. | 430/522 |
| 3,594,171 | 7/1971 | Kimura et al. | 430/517 |
| 3,705,807 | 12/1972 | Busatto | 430/522 |
| 4,594,312 | 6/1986 | Sabongi et al. | 430/522 |
| 4,876,181 | 10/1989 | Proehl et al. | 430/522 |
| 4,973,572 | 11/1990 | DeBoer | 430/945 |
| 5,057,406 | 10/1991 | Usagawa et al. | 430/517 |

FOREIGN PATENT DOCUMENTS 3231738 10/1991 Japan .

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A silver halide photographic material for laser exposure comprising at least one silver halide emulsion layer on a support, wherein said support or photographic constituent layers of said material contain an antihalation dye which exhibits a spectral absorption density of 0.4 or more before development with respect to the wavelength corresponding to the laser used and a spectral absorption density of 0.2 or more after development when the fluctuations of the average visual density excluding the support density and emulsion fog density are 0.02 or less.

4 Claims, 1 Drawing Sheet

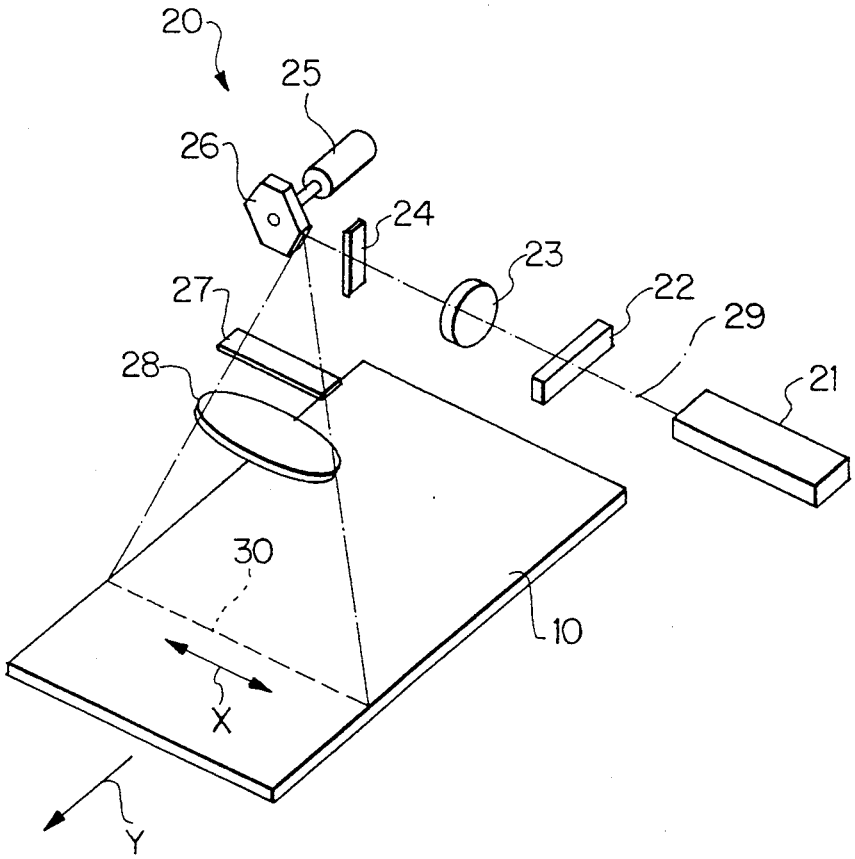
20
25
26
24
23
22
29
21
27
28
30
10
X
Y

SILVER HALIDE PHOTOGRAPHIC MATERIAL FOR LASER EXPOSURE

FIELD OF THE INVENTION

The present invention relates to a photographic material for laser exposure. More particularly, the present invention relates to a photographic material for laser exposure having excellent properties, including the capability of being rapidly processed in an automatic development procedure. The present invention is also directed to a process for the formation of an image using this silver halide photographic material.

BACKGROUND OF THE INVENTION

In recent years, the use of medical image diagnosis apparatus has increased with the progress of computer technology. As a result, there has also been a large increase in the need for hard copies for diagnostic records. Thus, imagers having a higher speed and a smaller size have been desired. However, even if a laser imager integrated with an automatic processor attains a high exposure speed, there is a waiting period if the photographic material cannot be processed rapidly in the automatic processor. Thus, it would be advantageous to adapt the photographic material to rapid processing. Previously if the automatic development is effected at a high speed, there have been problems in that strong residual color takes place due to elution of the photographic material with the processing solutions. It has also been disadvantageous in that decomposition of the photographic material takes place by the change in the hydrogen ion concentration or completion of the processing without sufficient progress of various reactions of antihalation dyes which have been reduced and decolored by sulfurous ions in the development, fixing and washing procedures in the automatic processor.

Further, these reactions can also take place as the temperature of the washing water becomes higher. Thus, the level of residual color may change with different temperatures of washing water, although this problem is often not recognized as being caused by uneven residual color. Hospitals in Japan often encounter the circumstances in which the temperature of washing water ranges from 5° to 6 ° C. in winter time to over 30° C. in summer time. However, practitioners of medical image technology often encounter the situation in which a current image is compared with records obtained several months ago to observe a change with time. Thus, the change in the image color from season to season is undesirable. In order to cope with these difficulties, the temperature of washing water must be kept constant. However, this approach is impractical since it causes a rise in energy loss and requires a space for the installation of an apparatus for keeping the temperature of washing water constant.

In order to accelerate these reactions, a water-soluble group, such as sulfonic group and carboxylic group, may be introduced into the dyes as disclosed in JP-A-62-123454 (the term "JP-A" as used herein means an "unexamined published Japanese patent application").

However, since the increase in the processing speed is remarkable particularly in the field of photographic material for laser light, these approaches are limited. Further, the number of antihalation dyes which can be selected for this purpose are limited as well.

Moreover, antihalation dyes which have been decolored are again colored due to side reactions, such as oxidation. As a result, these antihalation dyes color the washing water or contaminate the roller in the automatic processor. In addition, antihalation dyes which have been concentrated (colored again) from the washing water by drying air on a squeeze roller may be then transferred to the photographic material being processed.

The above-stated trouble due to use of the antihalation dyes which have been colored again often takes place as the replenishment rate of the developer or fixing solution is decreased, making it difficult to reduce the amount of waste developer or fixing solution.

SUMMARY OF THE INVENTION

It is therefore an object of the present invention to provide a silver halide photographic material for laser light which exhibits an excellent capability for being rapidly processed in an automatic development procedure while eliminating the aforementioned difficulties.

It is another object of the present invention to make a positive use of hydrophobic dyes, which have heretofore been rarely used as antihalation dyes.

These and other objects of the present invention will become more apparent from the following detailed description and examples.

The objects of the present invention are accomplished with a silver halide photographic material comprising at least one silver halide emulsion layer on a support, wherein said support or photographic constituent layers contain an antihalation dye which exhibits a spectral absorption density of 0.4 or more with respect to the wavelength corresponding to the laser light used before development and a spectral absorption density of 0.2 or more after development when the fluctuations of the average visual density excluding the support density and emulsion fog density are 0.02 or less. Preferably, the density of the antihalation layer before development is 0.45 or more, particularly 0.5 or more with respect to the laser used, or preferably 0.7 or more if the laser imager is a flat bed type scanner.

BRIEF DESCRIPTION OF THE DRAWING

By way of example and to clarify the description, reference is made to the accompanying drawing.

The FIGURE is a schematic diagram illustrating a flat bed type scanner which can be preferably used in the present invention wherein reference numeral 10 indicates a silver halide photographic material, reference numeral 20 indicates a laser recording apparatus, reference numeral 21 indicates a laser source, reference numeral 22 indicates a modulator, reference numeral 23 indicates a beam enlarger, reference numerals 24, 28 each indicates a converging lens, reference numeral 25 indicates a motor, reference numeral 26 indicates a polygon mirror, reference numeral 27 indicates a beam shaper, reference numeral 29 indicates a laser beam, and reference numeral 30 indicates a forward edge detecting sensor.

DETAILED DESCRIPTION OF THE INVENTION

Measurement of average visual density

The visual density of the above mentioned dye, in the case of a photographic material for image observation by transmission, is obtained by averaging measurements (n=5) given by means of Type TD-904 densitometer available from Macbeth through a visual filter. In the case of a photographic material for image observation by reflection, the visual density of the dye is obtained by averaging measurements (n=5) given by means of Type RD-917 densitometer available from Macbeth through a visual filter.

Type TD-904 and RD-917 densitometers available from Macbeth are preferably modified such that the density indication can be made down to 1/1000 decimal place. Further, in the measurement of transmission density, the density value is preferably obtained by dividing the measurement of a stack of 5 specimens by 5.

Measurement of fluctuations of the average visual density

The fluctuations of the average visual density in the present invention means fluctuations of the average visual density of the respective spots having an interval of about 5 mm on the whole surface of the film obtained by processing an unexposed film with an automatic processor (i.e., developing, fixing, washing and drying).

Any laser may be -used in the exposure of the photographic material of the present invention. Examples of lasers include ion gas lasers, such as argon laser and krypton gas laser; metal vapor lasers, such as copper, gold, sodium, barium and cadimium vapor lasers; solid lasers, such as ruby and YAG lasers, excimer lasers, He-Ne laser, argon laser; and semiconductor lasers., such as a gallium-arsenic laser. Most preferred among these lasers are red light-emitting or infrared light-emitting semiconductor lasers, which are small-sized, low cost lasers exhibiting excellent stability, reliability, durability and ease of modulation. Preferred next to these semiconductor lasers are He-Ne lasers and argon lasers.

Particularly preferred among these lasers are 780 nm GaAs junction type semiconductor lasers because of their ease of circuit design or optical system design and low cost.

The antihalation dye of the present invention may be incorporated in the support or photographic constituent layers of the silver halide photographic material.

Examples of photographic constituent layers in which the antihalation dye is incorporated include the silver halide emulsion layer, interlayer, subbing layer, and backing layer. Preferred among these photographic constituent layers are light-insensitive hydrophilic colloidal layers, such as the interlayer and backing layer.

The antihalation dye may be incorporated in light-insensitive hydrophilic colloidal layers on both sides of the support.

If emulsion layers are provided only on one side of the support, the antihalation layer is preferably located in a layer on the opposite side of the support (backing layer). Alternatively, the antihalation layer may be preferably provided as a layer between the emulsion layer and the support.

The amount of the antihalation dye to be incorporated may be in any range so far as it is effective for the desired purpose. If the antihalation layer exhibits a spectral absorption density of 0.3 or less with respect to the laser used, there is a deterioration of sharpness. Therefore, the antihalation layer needs to exhibit a spectral absorption density of 0.4 or more, preferably 0.45 or more, particularly 0.5 or more with respect to the wavelength of the laser used. Further, it is important to visually observe that the color tone of hard copies thus obtained are adequate. Heretofore, antihalation dyes have contained water-soluble groups incorporated therein to accelerate the elution of the dyes in the photographic material with a processing solution during the automatic development procedure. However, the elution of dyes is limited with the expedition of the automatic development system, leaving the problem of residual color.

If the elution of dyes takes place uniformly, the resulting residual color is observed to give no problems and can be tolerated. In practice, however, the photographic material being automatically developed is susceptible to uneven residual color, i.e., the forward edge portion and the side marginal portions of the photographic material being automatically developed exhibit less residual color while the central and tailing edge portions of the photographic material exhibit more residual color. Uneven residual color is visually recognized if the fluctuations of the average visual density exceeds 0.02. In order to prevent uneven residual color, it is necessary that the fluctuations of the average visual density, except the support density and emulsion fog density, be controlled to 0.02 or less in the automatic development procedure.

The inventors have found that uneven residual color can be eliminated by suppressing the elution capability of antihalation dyes rather than accelerating it by introducing a water-soluble group as has been previously done. It has also been found that this approach also causes less change in residual color with the temperature of washing water. In particular, it was found that water-insoluble or slightly water-soluble dyes can provide preferred results. As the absorption by the dye in the visible light range decreases, the uneven residual color decreases as well. Therefore, antihalation dyes having less absorption in the visible light range are preferred. Further, preferred antihalation dyes are those in which the absorption in the wavelength range of certain light transmitted thereby is as low as possible, the absorption in the wavelength range of light absorbed thereby is as high as possible, and the change in the wavelength of light transmitted thereby and light absorbed thereby is sharp, providing a high color purity. In particular, for the observation of medical image records, blue dyes are preferred to avoid operator eyestrain. Therefore, the color of the image background is advantageously blue. Accordingly, the antihalation dyes of the present invention preferably exhibit a spectral absorption density of 0.4 or more with respect to the laser used and less absorption in the visible light range. Alternatively, if there has to be any residual color caused by the antihalation dyes, it is preferably visually advantageous. In particular, dyes which exhibit absorption with respect to an infrared-emitting semiconductor laser cause blue residual color, and therefore are suitable for this purpose. Even water-soluble antihalation dyes which have heretofore been widely used cause no uneven residual color when used in a small amount. Therefore, water-insoluble or slightly water-soluble antihalation dyes and water-soluble antihalation dyes can be used in combination.

In general, medical image recording laser imager film purposely contain a blue dye in the support in an amount of 0.1 to 0.3 as calculated in terms of average visual density. The film for the laser imager according to the present invention can utilize the color of an antihalation dye left after development if the antihalation dye is light blue. In other words, an arrangment can be designed such that the antihalation dye is added so that the blue density is preferably in the range of 0.04 to 0.3, more preferably from 0.05 to 0.3 as residual color, after development, and a blue density of 0.1 to 0.3 is obtained together with a blue dye contained in the support or the back layer, interlayer, antihalation layer, emulsion layer or protective layer in the photographic material, thus enabling a drastic drop in the amount of the dye to be used in the coloring of the support.

The antihalation dyes used in the present invention include those having a spectral absorption wavelength of 780 nm or less, with those having a spectral absorption wavelength in the range of from 600 to 780 nm being preferred.

A blue dye is preferably incorporated in the antihalation layer in the film for laser imager according to the present invention. Preferred next to such a blue dye is one having less absorption in the visible light range in the vicinity of 450 to 700 nm.

If an antihalation dye which has some residual color is undesirably tinted, it is preferably corrected with another dye. For example, a yellowish residual color can be corrected by the addition of cyan and magenta dyes. A anthraquinone dye may be preferably used as a color tone adjusting dye. Such a dye may be incorporated in any one or some of layers constituting the photographic material such as the support, layers adjacent to the support, emulsion layer, interlayer, back layer and protective layer.

Dyes to be incorporated in the antihalation layer for infrared-emitting semiconductor laser are particularly preferred. Preferred next to the antihalation layer for infrared-emitting semiconductor laser, is the antihalation layer for He-Ne laser or red light-emitting semiconductor lasers. Similarly, an antihalation layer for a laser light having a wavelength shorter than 420 nm is preferred since most ultraviolet-absorbing dyes are almost colorless or slightly yellowish in the visible light range.

An ultraviolet absorbent having an absorption peak in the range of 300 nm to 400 nm, more preferably 300 nm to 380 nm may be preferably used as an antihalation layer for ultraviolet laser according to the present invention.

Examples of such an ultraviolet absorbent include aryl-substituted benzotriazole compound, 4-thiazolidone compound, benzophenone compound, cinnamic ester compound, butadiene compound, benzoxazole compound, and ultraviolet-absorbing polymer.

Specific examples of ultraviolet absorbents are disclosed in U.S. Pat. Nos. 3,533,794, 3,314,794, 3,352,681, 3,705,805, 3,707,375, 4,045,229, 3,700,455, and 3,499,762, JP-A-46-2784, West German Patent Application Disclosure No. 1,547,863, etc.

The antihalation dye of the present invention will be further described hereinafter with reference to the infrared-absorbing dye, which is the most preferred embodiment thereof, by giving exemplary compounds.

Examples of such an infrared-absorbing dye include cyanine dye, phthalocyanine dye, pyrilium dye, thiopyrilium dye, azlenium dye, squarilium, Ni or Cr metal complex dye, naphthoquinone dye, anthraquinone dye, indophenol dye, indoaniline dye, triphenylmethane dye, triallylmethane dye, aminium dye, diimmonium dye, and nitroso compound.

Particularly preferred among these dyes are those having a high absorption in the near infrared range from 700 nm to 900 nm, since the fact that semiconductor lasers emitting near infrared light have been put into practical use. Specific examples of such dyes include those represented by the following general formulae:

(1) Cyanine dye

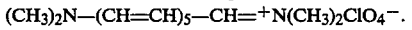

$(CH_3)_2N-(CH{=}CH)_5-CH{=}^{+}N(CH_3)_2ClO_4^{-}$.

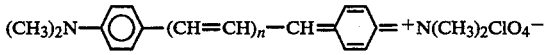

$(CH_3)_2N-C_6H_4-(CH{=}CH)_n-CH{=}C_6H_4{=}^{+}N(CH_3)_2ClO_4^{-}$ wherein n represents an integer 2 or 3.

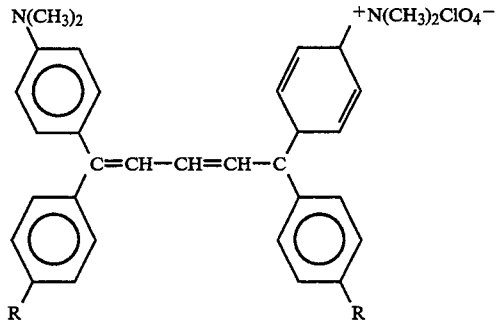

wherein R represents a hydrogen atom or $N(CH_3)_2$.

$A-(CH{=}CH)_n-CH{=}B$ wherein A represents any of groups represented by the following general formulae:

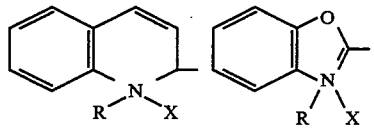

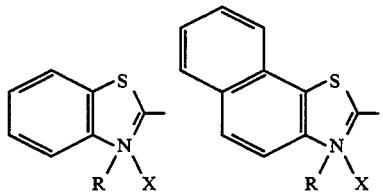

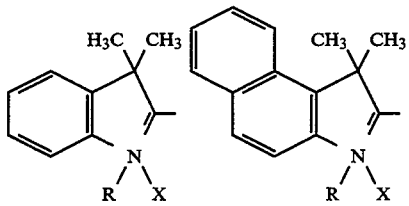

and B represents any of the groups represented by the following general formulae:

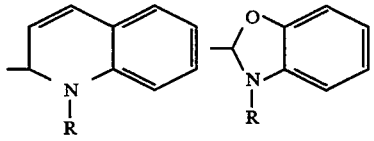

-continued

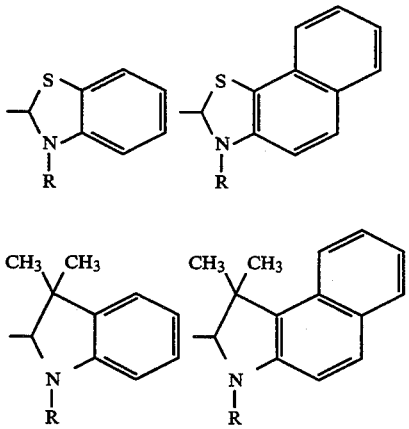

R represents an alkyl group. X represents a counter ion. The benzene ring or naphthalene ring may optionally comprise chlorine atom, alkyl group, alkoxy group or aryl group present therein. The subscript n represents an integer 0 to 3.

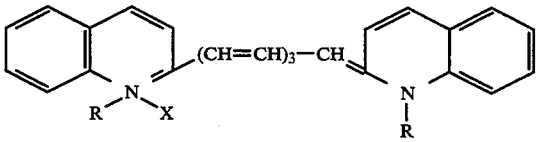

wherein R represents an alkyl group; and X represents a halogen atom.

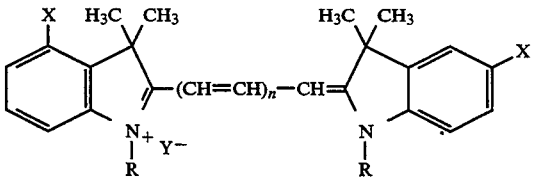

wherein R represents a substituted or unsubstituted alkyl group, alkoxy group or alkenyl group; X represents a hydrogen atom or halogen atom; Y represents a halogen atom, perchlorate or substituted or unsubstituted benzene sulfonate, paratoluene sulfonate, methyl sulfate, ethyl sulfate, benzene carboxylate, methyl carboxylate or trifluoromethyl carboxylate; and n represents an integer of 0 to 3.

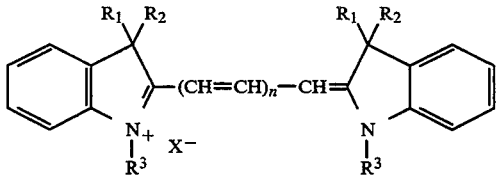

wherein $R^1$, $R^2$ and $R^3$, which may be the same or different, each represents a substituted or unsubstituted alkyl group; $X^-$ represents a perhalogenic ion, toluenesulfonic ion or alkylsulfuric ion; and n represents an integer 0 to 3. A halogen atom is present in at least one of 4-, 5-, 6- and 7-positions in the indolenine ring. A halogen atom may optionally be further present in other positions. Further, the benzene ring may be optionally substituted by alkyl group, alkoxy group, hydroxyl group, allyl group or alkali carbonyl group.

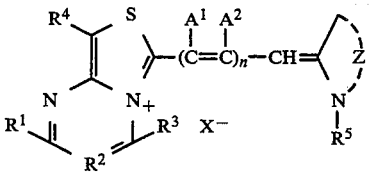

wherein $A^1$ and $A^2$ each represents a hydrogen atom or substituent; Z represents an atomic group necessary for the formation of a 5-membered heterocyclic group; $R^1$ to $R^4$ each represents a hydrogen atom or substituent; $R^5$ represents a substituent, which may form a 6-membered heterocyclic group with Z; $X^-$ represents an anion; and n represents an integer 0 to 2.

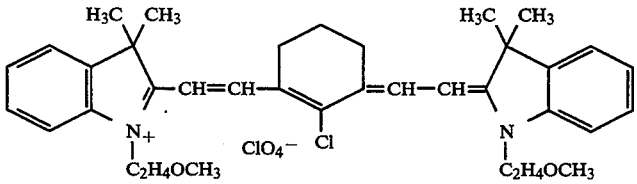

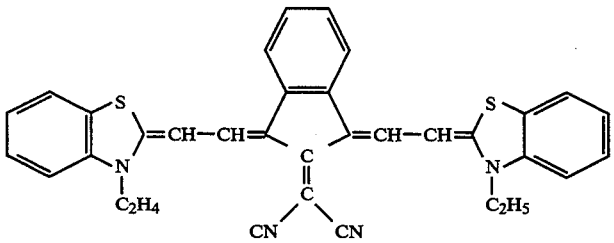

Chemical formula: $\Phi-L=\psi(X^-)_m$ wherein $\Phi$ and $\psi$ each represents an indole ring residue, thiazole ring residue, oxazole ring residue, selenazole ring residue, imidazole ring residue or pyridine ring residue with which an aromatic ring may be condensed; L represents a connecting group for the formation of monocarbocyanine, dicarbocyanine, tricarbocyanine or tetracarbocyanine; and m represents an integer 0 or 1.

Particularly preferred are compounds represented by the following general formula as disclosed in JP-A-2-2074:

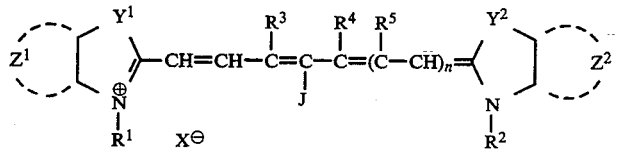

or

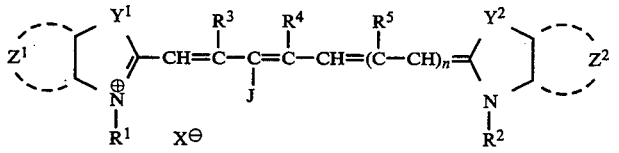

wherein $R^1$, $R^2$, $R^3$, $R^4$ and $R^5$ each independently represent a substituted or unsubstituted alkyl group which may form a ring via methine chain.

$Z^1$ and $Z^2$ each represent hydrogen atoms or an atomic group necessary for the formation of a substituted or unsubstituted aromatic group.

$Y^1$ and $Y^2$ each represent a carbon atom, vinylene group, oxygen atom, sulfur atom or seleniumiatom substituted by alkyl group. J represents a hydrogen atom, substituted or unsubstituted alkyl group, substituted or unsubstituted aryl group, halogen atom or nitrogen atom substituted by atoms necessary for the formation of a 5- or 6-membered ring; n represents an integer of 0 or 1; and X represents a monovalent anion.

In a preferred embodiment, $R^1$ and $R^2$ are each methyl groups, J is a hydrogen atom, $R^3$ and $R^4$ form a 6-membered ring, $Z^1$ and $Z^2$ are each an atom which forms a benzene ring substituted by nitro group, halogen atom or cyano group, and $Y^1$ and $Y^2$ are each a dialkyl-substituted carbon atom.

Preferred among the compounds represented by the foregoing general formula are Compounds 1 to 12 as disclosed in JP-A-2-2074.

Further, squarilium dyes, azlenium dyes, indophenol dyes, metal complex dyes, naphthoquinone dyes, anthraquinone dyes, etc. may be preferably used.

The antihalation dye of the present invention is preferably water-insoluble or slightly water-soluble. However, even if the antihalation dye of the present invention is soluble in water, it is possible to make the dye difficultly elutable from the photographic material in practice by using a mordant layer or by properly adjusting the film properties as well. Thus, by employing the embodiment of the present invention, such a water-soluble dye can be easily used with less uneven residual color even using rapid processing. When One incorporates a slightly water-soluble or water-insoluble hydrophobic dye in hydrophilic layers constituting the photographic material, troubles due to agglomeration often take place. The hydrophobic antihalation dye of the present invention is preferably used in the form of an emulsion obtained by dissolving the dye in a slightly water-soluble or water-insoluble organic solvent, followed by emulsifying and dispersing.

A hydrophobic dye having an absorption maximum from 570 nm to 700 nm in the visible light range (400 nm to 700 nm) is preferably used as the dye (color tone adjusting dye) for correction of the color tone of antihalation dyes left in the photographic material. Examples of dyes having a desired absorption maximum include anthraquinone dye, azo dye, azomethine dye, indoaniline dye, oxonol dye, triphenylmethane dye, carbocyanine dye, and styryl dye. These dyes can be incorporated in the layers constituting the photographic material in the form of a dispersion in a high boiling solvent or low boiling solvent separately from or in admixture with the above mentioned antihalation dye. If this dye is incorporated in the support, a proper means such as kneading can be used. Thus, residual color, which has previously been considered undesirable, can be positively used to overcome the problem of decoloration of antihalation dyes, the rate-determining step of which is a dispersion process that limits the rapidity in the processing.

Specific examples of dye compounds to be used for this purpose in the present invention include Exemplary Compound Nos. 1 to 56 as disclosed in JP-A-3-231738, pp. 3–7. The range of light visible by human eyes is described in Hiroshi Kubota et al., "Kogaku Gijutsu Handbook (Handbook of Optical Technology)", Asakura Shoten, 1968, page 729.

The silver halide photographic material for laser light according to the present invention comprises one or more silver halide emulsion layers on either or both sides of the support.

The kind of the silver halide emulsion to be used in the present invention may be any one of a negative type, an internal latent image type using a nucleating agent, and a previously-coated autopositive type using an autopositive electron-catching agent.

The types of light-sensitive silver halide to be used in the present invention include silver bromide, silver bromoiodide, silver chloride, silver bromochloride, silver bromoiodide, silver bromochloroiodide. Preferably used are silver bromide, silver bromoiodide, silver bromochloride or silver bromochloroiodide. The silver iodide content in the silver halide is preferably in the range of 0 to 4 mol %, more preferably 0 to 2 mol %. The silver chloride content in the silver halide is preferably in the range of 80 mol % or less, more preferably 40 mol % or less.

The emulsion preferably contains emulsion grains having an average grain diameter (number-average) of about 0.2 μm to about 0.6 μm, more preferably 0.25 μm to 0.5 μm as determined by the projected area process. The emulsion may be a mixture of coarse grains and fine grains.

The silver halide grains to be used in the present invention may have a regular crystal form such as cube, octahedron and tetradecahedron or an irregular crystal form such as potato-like form, sphere, tablet and plate having a grain diameter of five times or more the grain thickness (further described in Research Disclosure Item No. 22534, pp. 20–58, January 1983). Tabular silver halide grains are particularly preferred among these Silver halide grains. The light-sensitive emulsions may be Used in admixture with a substantially light-insensitive emulsion ( e.g., internally-fogged emulsion of finely divided grains). These emulsions may be coated on separate layers.

Further, the crystal structure of the silver halide grains may be such that the composition is uniform or the grains may have a layer structure in which the composition is heterogeneous from the core to the shell. Alternatively, the crystal form of silver halide grains may be the so-called conversion type as described in British Patent 635,841, and U.S. Pat. No. 3,622,318.

In order to control the growth of grains during the formation of the silver halide grains, silver halide solvents may be used and suitable examples include ammonia, potassium thiocyanate, ammonium thiocyanate, thioether compound (as described in U.S. Pat. Nos. 3,271,157, 3,574,628, 3,704,130, 4,297,439, and 4,276,374), thione compound (as described in JP-A-53-144319, 53-82408, and 55-77737), amine compound (as described in JP-A-54-100717) or the like. In addition to silver halide solvents, a compound which is adsorbed to the surface of grains to control the crystal habit thereof, such as a cyanine dye, a tetrazaindene compound and a mercapto compound may be used during the formation of the grains.

The silver halide emulsion used in the present invention may be a monodisperse or a polydisperse, preferably monodisperse emulsion. Two or more monodisperse emulsions having different grain sizes may be used in admixture, if desired.

The emulsion of the present invention may be a negative type or an autopositive type emulsion (internal latent image type using a nucleating agent and a previously-fogged type using an electron-catching agent).

The silver halide emulsion in the photographic material of the present invention may contain metallic ions such as iridium ion.

If, for example, iridium ions are to be incorporated in the silver halide emulsion, a method is normally used which comprises the addition of a water-soluble iridium compound (e.g., hexachloroinedate (IV)) in the form of aqueous solution during the preparation of silver halide emulsion. Such a water-soluble iridium compound may be added in the form of the same aqueous solution as halide for the formation of silver halide grains. Alternatively, such a water-soluble iridiumcompound may be added before or during the formation of silver halide grains or between after the formation of silver halide grains and the chemical sensitization of silver halide grains. In particular, such a water-soluble iridium compound is preferably added during the formation of silver halide grains.

The negative type emulsion Which can be used in the present invention may be subjected to commonly used chemical sensitization, e.g., sulfur sensitization (as disclosed in U.S. Pat. Nos. 1,574,944, 2,278,947, 3,021,215, 3,635,717), reduction sensitization (as disclosed in U.S. Pat. No. 2,518,698, *Research Disclosure,* No. 17643, vol. 176 (December 1978), Item 3), sensitization with a thioether compound (as disclosed in U.S. Pat. Nos. 2;521,926, 3,021,215, 3,046,133, 3,165,552, 3,625,697, 3,635,717, 4,198,240) and combinations thereof.

Specific examples of chemical sensitizers which can be used in these chemical sensitizationn methods include sulfur sensitizers such as sodium thiosulfate, allyl thiocarbamide, thiourea, thiosulfate, thioether and cystine, and reduction sensitizers such as tin chloride, phenylhydrazine and reductone. Further, so-called selenium sensitization can be conducted.

The negative type emulsion which can be used in the present invention is preferably subjected to gold sensitization (as disclosed in U.S. Pat. Nos. 2,540,085, 2,399,083). Specific examples of gold sensitizers which can be used in gold sensitization include potassium chloroaurate, aurous thiosulfate, and potassium chloropalladate. These gold compounds may be added before or after the addition of the sulfur sensitizer. Alternatively, these gold compounds may be added simultaneously with the addition of the sulfur sensitizer.

The amount of the gold sensitizer to be used in the present invention is preferably in the range of $10^{-7}$ to $10^{-3}$ mol, particularly $10^{-6}$ to $10^{-4}$, mol per mol of silver halide.

The sensitizing dye incorporated into the medical image recording film for laser imaging according to the present invention may be infrared-sensitizing dye, panchromatic sensitizing dye, orthochromatic sensitizing dye and regular sensitizing dye.

Among these sensitizing dyes, panchromatic sensitizing dyes or infrared-sensitizing dyes may would likely be used in view of the widespread use of He-Ne lasers or semiconductor lasers. Cubic silver halide grains are preferably used as the silver halide grains.

In order to adapt the photographic material of the present invention to be sensitive to both He-Ne laser (633 nm) and semiconductor laser (780 nm), a panchromatic sensitizing dye and an infrared-sensitizing dye are preferably used in combination. In order to adapt the photographic material of the present invention to be sensitive to both He-Ne laser (633 nm) and semiconductor laser (678 nm), two kinds of panchromatic sensitizing dyes are preferably used in combination.

At least one of tricarbocyanine dyes and/or 4-quinoline nucleus-containing dicarbocyanine dyes as disclosed in JP-A-63-89838 may be used as an infrared spectral sensitizer in the present invention. Further, those dyes disclosed in JP-A-59-192242 and 59-191032 may be used.

Suitable panchromatic sensitizing dyes which may be used are those disclosed in JP-B-43-4933, and 60-45414.

The amount of the above-described spectral sensitizing dyes incorporated into the negative type silver halide emulsion of the present invention is in the range of $10^{-7}$ to $10^{-2}$ mol, preferably $10^{-6}$ to $10^{-3}$ mol, per mol of silver halide.

Further, other sensitizing dyes may be used in the present invention. For example, spectral sensitizing dyes as disclosed in U.S. Pat. Nos. 3,703,377, 2,688,545, 3,397,060, 3,615,635, 3,628,964, 3,416,927, 3,615,613, 3,615,632, 3,617,295, and 3,635,721, British Patents 1,242,588, and 1,293,862, and JP-B-43-4936, 44-14030, 43-10773, and 43-4930 may be used. Moreover, the above-described infrared sensitizing dyes and the spectral sensitizing dyes may be used in combination.

Compounds as disclosed in JP-A-63-89838 can be used in combination with the above mentioned sensitizing dyes in the present invention, for the purpose of further enhancing supersensitizing effects as a supersensitizer.

Moreover, preservability improvers as disclosed in JP-A-63-89838 can be used in combination with the above mentioned sensitizing dyes in an amount of about 0.01 to 5 g per mol of silver halide in the emulsion.

The photographic material of the present invention may comprise various compounds incorporated therein to inhibit a sensitivity drop or fogging during the preparation, storage or processing thereof.

An extremely large number of compounds such as heterocyclic compounds (e.g., nitrobenzeneimidazole, ammonium chloroplatinate, 4-hydroxy-6-methyl-1,3,3a,7-tetrazaindene, 1-phenyl-5-mercaptotetrazole), mercury-containing compounds, mercapto compounds and metal salts are well known examples of these compounds. Examples of these compounds which can be actually used are described in C. E. K. Mees, *The Theory of the Photographic Process,* 3rd edition, 1966, pp. 344–349, and the original references cited therein. Examples of such compounds include thiazolium salts as disclosed in U.S. Pat. Nos. 2,131,038, and 2,694,716, azaindenes as disclosed in U.S. Pat. Nos. 2,886,437, and 2,444,605, urazoles as disclosed in U.S. Pat. No. 3,287,135, sulfocatechols as disclosed in U.S. Pat. No. 3,236,652, oximes as disclosed in British Patent 623,448, mercaptotetrazoles, nitron, and nitroindazoles as disclosed in U.S. Pat. Nos. 2,403,927, 3,266,897, and 3,397,987, polyvalent metal salts as disclosed in U.S. Pat. No. 2,839,405, thiuronium salts as disclosed in U.S. Pat. No. 3,220,839, and palladium, platinum and gold salts as disclosed in U.S. Pat. Nos. 2,566,263, and 2,597,915. These compounds may be added in the form of precusors thereof.

The crystal face of silver halide grains incorporated in the emulsion which can be used in the present invention may be either a 100 plane or a 111 plane. The ratio of the 100 plane to the 111 plane is preferably in the range of 1 or more.

A monodisperse emulsion of silver halide grains having a 100 plane/ill plane ratio of 1 or more can be prepared by various methods.

The silver halide emulsion which can be used in the present invention preferably comprises silver halide grains having a 100 plane/ill plane ratio of 1 or more, preferably 2 or more, more preferably 4 or more in an amount of 50 wt. % or more, more preferably 60 wt. % or more, particularly 80 wt. % or more.

In the photographic material of the present invention, the light-sensitive silver halide emulsion layer may be coated on either or both sides of the support.

The silver halide emulsion of the present invention may contain other conventional photographic additives. Stabilizers which may be incorporated in the silver halide emulsion are triazoles, azaindenes, quaternary benzothiazolium compounds, mercapto compounds, or water-soluble inorganic salts such as cadmium, cobalt, nickel, manganese, gold, thallium and zinc salts. Typical film hardeners which may be incorporated in the silver halide emulsion are aldehydes such as formaldehyde, glyoxal and mucochloric acid, S-triazinic acid, epoxy, aziridines, vinylsulfonic acid, or the like. Suitable coating aids which may be incorporated in the silver halide emulsion are saponine, sodium polyalkylenesulfonate, lauryl or oleylmonoether of polyethylene glycol, amylated alkyltaurine, fluorine-containing compounds, or the like. Further, color couplers can be incorporated in the silver halide emulsion. In addition to these photographic additives, brightening agents, ultraviolet absorbents, preservatives, matting agents, and antistatic agents may be incorporated in the silver halide emulsion as desired.

Moreover, the silver halide emulsion of the present invention may contain a so-called filter dye incorporated therein. The filter dye may be separately coated on the various emulsion layers or may be separately coated on various layers such as the interlayer and the protective layer. Further, a plurality of dyes may be used in an admixture.

The chemical structure of these dyes is not specifically limited. Oxonol dyes, hemioxonol dyes, melocyanine dyes, cyanine dyes, azo dyes, etc. can be used.

Of course, the ordinary photographic processing may be followed by a procedure for changing the colors. It is also advantageous to correct the silver tone by the color of dyes.

In order to adapt the aforementioned medical image recording film to both He-Ne laser (633 nm) and semiconductor laser (780 nm), the dye incorporated in the antihalation layer needs to be selected from those having sufficient absorption at 633 nm and 780 nm, combined with the selection of the aforementioned sensitizing dyes, so that the density is 0.4 or more at the two wavelengths.

Example of dyes having absorption in the visible light range include those described in JP-A-61-174540.

In the silver halide light-sensitive material of the present invention, the antihalation dye-containing layer may be located between the emulsion layer and the support or on the the other side of the support.- Preferably, the antihalation dye-containing layer is located on a back layer on the other side of the support. The transmission density of the dye-containing layer at the wavelength of the exposing light source is in the range of 0.4 or more, preferably 0.45 or more, more preferably 0.5 or more. The antihalation dyes may be added in the form of an aqueous solution, micelle dispersion, solid dispersion or the like, depending on their properties.

The laser scanner which is used with the photographic material of the present invention is normally equipped with a film forward edge detecting mechanism to provide an exposure intitiating signal. In order to accurately initiate exposure from the position with which the film edge portion is brought into contact, the film forward edge detecting mechanism is preferably disposed directly under the laser scanning portion. In a flat bed type scanner such as Type CR-LP414 scanner available from Fuji Photo Film Co., Ltd., the mounting holes for the film forward edge detecting sensor are located opposite the laser scanning portion. The film alone is passed over the film forward edge detecting sensor. Therefore, these holes make some difference in the amount of reflected laser light from scanned position to scanned position. If the film has insufficient antihalation effect, the difference in the amount of reflected laser light results in the appearance of marks during the formation of images. These marks will appear all over the entire length of the film. In order to avoid these marks, the surface of the flatbed opposite the laser source is coated with a color that absorbs the wavelength of the exposing laser. However, such an approach leads to highers costs. Further, if the coated surface is scratched, it also results in the appearance of marks. Accordingly, the transmission density of the antihalation dye layer is in the range of 0.4 or more, preferably 0.45 or more, particularly 0.5 or more with respect to the wavelength of the light source. If the surface opposite the laser scanning portion is metalescent, the antihalation layer must have a transmission density of 0.7 or more to attain perfection. In the case where the quest for fine shade is required as in medical image recording, the antihalation layer preferably has a transmission density of 0.7 or more.

In another type of scanner, the film is exposed while being carried fixed to a fixing plate that adsorbs the film. In this type of scanner, gutters or small holes for adsorption of the film are disposed all over the fixing plate. These gutters or small holes result in the appearance of marks as in the aforementioned scanner. In the case of a drum type scanner in which the film is moved while being wound around a drum, the difference in the amount of reflected laser due to stain or scratch on the drum results in the appearance of spot marks rather than over the entire length of the film. However, even such spot marks cannot be neglected since the criterion of diagnosis in the medical image recording process may include fine spot shades. By providing sufficient antihalation, an inexpensive electro-optical switch suitable for the detection of film which serves to detect the position or forward edge of the film at a high precision in a non-contact manner can be easily used. An electro-optical sensor may be provided opposed to a back layer containing an antihalation dye so that the light energy of the electro-optical sensor is absorbed by the antihalation dye to expose the light-sensitive emulsion less to light.

Specific examples of antihalation dyes to be incorporated in the photographic material sensitive to light in the wavelength range of 360 nm to 700 nm include the following exemplary compounds:

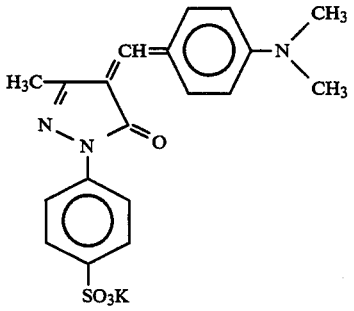

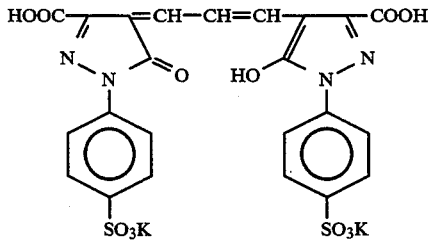

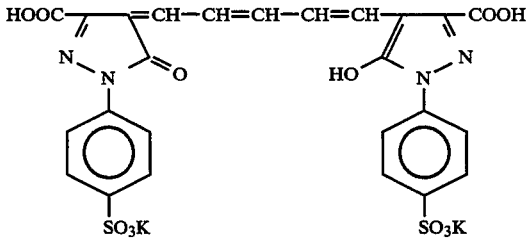

In the case of an infrared exposing light source, a dye having substantial absorption in a long wavelength range of longer than 750 nm may be used as an antihalation dye and/or irradiation-inhibiting dye. The antihalation dye is used for the interlayer, subbing layer, antihalation layer, back layer, emulsion layer, etc. The irradiation-inhibiting layer is used for the emulsion layer as well as the interlayer or the like. This dye may be preferably used in an amount of $10^{-3}$ to 1 g/m$^2$, more preferably $10^{-3}$ to 0.5 g/m$^2$. These dyes may be used singly or in combination. In order to adapt the photographic material to two or more kinds of lasers, it is preferred that an infrared-absorbing dye or ultraviolet-absorbing dye is left in the photographic material and a visible light-absorbing dye does not leave its color.

Instead of or in combination with the aforementioned dyes, other dyes may be used. Examples of such dyes include pyrazolone oxonol dyes as disclosed in U.S. Pat. No. 2,274,782, diarylazo dyes as disclosed in U.S. Pat. No. 2,956,879, styryl dyes and butanedienyl dyes as disclosed in U.S. Pat. Nos. 3,423,207, and 3,384,487, melocyanine dyes as disclosed in U.S. Pat. No. 2,527,583, melocyanine dyes as disclosed in U.S. Pat. Nos. 3,486,897, 3,652,284, and 3,718,472, and enaminohemioxonol dyes as disclosed in U.S. Pat. No. 3,976,661.

Further, dyes as disclosed in JP-A-61-174540 can be used.

The various additives to be incorporated in the photographic material of the present invention are not specifically limited besides those aforementioned. Those described in the following references can be used.

| Item | | Reference |
|---|---|---|
| 1) | Silver halide emulsion and preparation method thereof | JP-A-2-68539, last 6 line, lower right column, p. 8 - line 12, upper right column, p. 10, JP-A-3-24537, line 10, lower right column, p. 2 - line 1, upper right column, p. 6, line 16, upper left column, p. 10 - line 19, lower left column, p. 11, JP-A-4-207442 |
| 2) | Chemical sensitization method | JP-A-2-68539, line 13, upper right column - line 16, upper left column, p. 10, Japanese Patent Application No. 3-105035 |
| 3) | Fog inhibitor, stabilizer | JP-A-2-68539, line 17, lower left column, p. 10 - line 7, upper left column, p. 11, line 2, lower left column, p. 3 - lower left column, p. 4 |
| 4) | Color tone improver | JP-A-62-276539, line 7, lower left column, p. 2 - line 20, lower left column, p. 10, JP-A-3-94249, line 15, lower left column, p. 6 - line 19, upper right column, p. 11 |
| 5) | Spectral sensitizing dye | JP-A-2-68539, line 4, lower left column, p. 4 lower right column, p. 8 |
| 6) | Surface active agent, antistatic agent | JP-A-2-68539, line 14, upper left column, p. 11 - line 9, upper left column, p. 12 |
| 7) | Matting agent, lubricant, plasticizer | JP-A-2-68539, line 10, upper left column, p. 12 - line 10, upper right column, p. 12, line 10, lower left column - line 1, lower right column, p. 14 |
| 8) | Hydrophilic colloid | JP-A-2-68539, line 11, upper right column - line 16, lower left column, p. 12 |
| 9) | Film hardener | JP-A-2-68539, line 17, lower left column, p. 12 - line 6, upper right column, p. 13 |
| 10) | Support | JP-A-2-68539, line 7 - line 20, upper right column, p. 13 |

-continued

| Item | | Reference |
|---|---|---|
| 11) | Crossover cut method | JP-A-2-264944, line 20, upper right column, p. 4 - upper right column, p. 14 |
| 12) | Dye, mordant | JP-A-2-68539, line 1, lower left column, p. 13 - line 9, lower left column, p. 14, JP-A-3-24537, lower left column, p. 14 - lower right column, p. 16 |
| 13) | Polyhydroxybenzenes | JP-A-3-39948, upper left column, p. 11 - lower left column, p. 12, EP 452772A |
| 14) | Layer configuration | JP-A-3-198041 |
| 15) | Development method | JP-A-2-103037, line 7, upper left column, p. 16 - line 15, lower left column, p. 19, JP-A-2-115837, line 5, lower left column, p. 3 - line 10, upper right column, p. 6 |

The flat bed type scanner which may be preferably used with a silver halide photographic material for laser exposure of the present invention will be further described hereinafter.

The FIGURE is a schematic diagram illustrating an embodiment of the laser recording appartatus according to the present invention.

The aforementioned photographic material 10 is exposed to laser light 29 without being wound around a drum. In the present invention, all laser scanning recording apparatus in which a photographic material is exposed to light without being wound around a drum will be hereinafter generally referred to as "flat bed type scanners".

In the FIGURE, a laser source 21 which emits laser light 29 is disposed above the photographic material (on the emulsion layer side).

A polygon mirror 26 which is rotated at a constant speed by a motor 25 is disposed ill such a position that it reflects laser light 29 to scan the photographic material 10. A modulator 22 for allowing an image data to be carried on laser light 29, a beam enlarger 23, andia converging lens 24 are provided on the light path between laser source 21 and polygon mirror 26 sequentially from laser source 21.

A beam shaper 27 and a converging lens 28 are provided on the light path between polygon mirror 26 and the photographic material 10.

A sensor 30 for detecting the forward edge of the photographic material 10 is provided directly under the scanning position of laser beam.

In this arrangement, image data can be recorded on the photographic material. In operation, the forward edge of the photographic material is detected by the forward edge sensor 30. The signal from the sensor initiates the image recording by the laser beam. The image data is recorded on the photographic material 10 while the material is being moved in the direction of arrow Y for secondary scanning with the image data (e.g., CT image) being carried on laser beam 29 from laser source 21 by modulator 22 and laser beam 29 being scanned in the direction of arrow X by polygon mirror 26. After exposing the light-sensitive layer, laser beam 29 is absorbed by the antihalation layer, reflected by a member of the apparatus provided under the photographic material (opposite laser beam), and then again absorbed by the antihalation layer. If the transmission density of the antihalation layer is not sufficient, the difference in the amount of reflected laser beam on the lower side of the photographic material is more than the antihalation layer can absorb, causing the light-sensitive layer to be exposed and hence resulting in the appearance of marks all over the entire length of the photographic material.

In the FIGURE, a polygon mirror is used for primary scanning (X direction). However, scanning may be effected in such an arrangement that a mirror is carried by a vertical rod based on the principle of a galvanometer.

The conveyance of the photographic material in the Y direction is normally conducted by moving the photographic material directly through a roller. However, the photographic material may be moved while being fixed on a stage.

In the FIGURE, an exposure Unit (21 to 28) including laser source 21 is fixed. However, the exposure unit (21 to 28) may be entirely moved in the Y direction with the photographic material being fixed.

Examples of special embodiments of scanner of the present invention include scanners as disclosed in U.S. Pat. No. 4,919,500, and SPIE vol. 1454 "Beam Deflection and Scanning Technologies", 1991, pp. 257–264.

In this case, the photographic material and the scanner which are both fixed are scanned by two mirrors for the X and Y directions. A detecting sensor is needed to properly locate the photographic material on the predetermined position.

As previously mentioned, the antihalation dye is normally eluted with the above mentioned processing solution while being subjected to decomposition due to hydrogen ion concentration or reduction with sulfurous ions in the development procedure or fixing procedure. As the processing of the photographic material proceeds, the concentration of the eluted components in the various processing solutions increases, reaching a predetermined value. It is also known that as the processing of the photographic material proceeds, the eluted components are again incorporated in the photographic material or brought into the subsequent processing bath with a processing solution attached to the surface of the photographic material. The concentration of the antihalation dye or its reaction products-in the processing solutions increases with the decrease in the replenishment rate of the developer or fixing solution per $m^2$ of photographic material. Further, as the amount of the washing water decreases, the concentration of the antihalation dye in the washing water in the washing bath increases. The above mentioned antihalation dye and its reaction products undergo side reaction, e.g., reaction with other components in the processing solution or oxidation by oxygen in the air, to develop colors again. These reaction products permeate and contaminate the conveying roller in the automatic processor. These reaction products are also incorporated in the photographic material or brought into the squeezing portion of the automatic processor with the washing water attached to the surface of the photographic material, concentrated on the squeeze roller by drying air, and then transferred to the film to be processed, contaminating the film. This trouble becomes extreme particularly when the replenishment rate of the developer and fixing solution is 395 ml per $m^2$ of photographic material.

The photographic material may be processed to adjust the maximum amount of washing water when the photographic material is present in the washing bath in the automatic processor to less than 3 l per minute.

The photographic material according to the present invention may be processed under the conditions that the duration between the moment at which the forward edge of the photographic material comes into the automatic processor and the moment at which the forward edge of the photographic material which has been processed comes out from the automatic processor is 40 seconds or less.

These problems caused by the antihalation dye are aggravated by the rise in the rate at which the photographic material is processed or by a drop in the replenishment rate of the developer or fixing solution and the amount of the washing water. In order to eliminate these problems, the content of the antihalation dye in the photographic material can be reduced. However, this approach also eliminates the antihalation effect. The present invention is remarkably effective to solve the two conflicting problems. The difference in the spectral absorption density with respect to the wavelength of laser light between before and after the processing of the photographic material is preferably less than 0.4, particularly less than 0.2.

The laser imager and the automatic processor are preferably connected and integrated to each other so that the photographic material which has been treated by the laser imager can be then processed without working in a darkroom.

In this arrangement, the conveying rate in the laser imager and in the automatic processor are preferably the same or the conveying rate in the automatic processor is preferably in the range of 100% to 110% of that in the laser imager. This is because when the conveying rate in the automatic processor is lower than that in the laser imager, a special waiting zone needs to be provided between the scanner portion of the laser imager and the automatic processor, increasing the size of the apparatus. In contrast if the conveying rate in the automatic processor is higher than that in the laser imager, a conveyance connecting zone including a ratchet machanism needs to be provided between the scanner portion and the automatic processor. The conveying rate in the automatic processor is particularly preferably in the range of 100% to 105% of the secondary scanning rate (Y direction) of the laser imager. The predetermined secondary scanning rate of the laser imager can be easily attained by using a high sensitivity photographic material. However, the enhancement of the conveying rate in the automatic processor has been very difficult due to the aforementioned problems. In accordance with the present invention, the conveying rate in the automatic processor can be enhanced, attaining the expedition of a laser imager integrated with an automatic processor.

The present invention will be further described in the following examples, but the present invention should not be construed as being limited thereto.

EXAMPLE 1

1. Preparation of silver halide emulsion A 40 g of gelatin were dissolved in 1 l of water. The solution was kept at a temperature Of 55° C. 3 g of potassium bromide and 60 mg of Compound (I) having the following general formula:

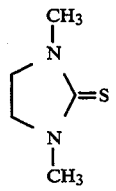

were added to the solution. 1,000 ml of an aqueous solution containing 200 g of silver nitrate and 1,080 ml of an aqueous solution of 140 g of potassium bromide containing potassium hexachoroiridate (III) in an amount of $10^{-7}$ mol per mol of silver were then added to the solution by the double jet process while the pAg value in the reaction vessel was kept at 7.0 to prepare a monodisperse emulsion of cubic silver bromide grains having an average grain size of 0.20 μm. The emulsion was then desalted. 71 g of gelatin were then added to the emulsion to adjust the pH and pAg values thereof to 6.0 and 8.5, respectively. The emulsion was then subjected to chemical sensitization with 3 mg of sodium thiosulfate, 4 mg of chloroauric acid and 0.2 g of 4-hydroxy-6-methyl-1,3,3a,7-tetrazaindene at a temperature of 60° C. to obtain Emulsion A.

2. Preparation of emulsion coating solution 850 g of Emulsion A were measured out and heated to a temperature of 40 ° C. in a vessel. The following compounds to prepare an emulsion coating solution were added:

| (Emulsion coating solution formulation A) | | |
|---|---|---|
| a. Emulsion A | 850 | g |
| b. Spectral sensitizing dye (II) | $1.2 \times 10^{-4}$ | mol |
| c. Supersensitizer (XVI) | $0.8 \times 10^{-3}$ | mol |
| d. Preservability improver (VI) | $1 \times 10^{-3}$ | mol |
| e. Polyacrylamide (molecular weight: 40,000) | 7.5 | g |
| f. Trimethylol propane | 1.6 | g |
| g. Sodium polystyrenesulfonate | 2.4 | g |
| h. Latex of poly(ethyl acrylate/ methacrylic acid) | 16 | g |
| i. N,N'-ethylenebis-(vinylsulfonacetamide) | 1.2 | g |

Spectral sensitizing dye (II)

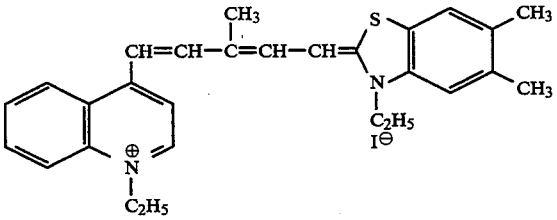

Supersensitizer (XVI)

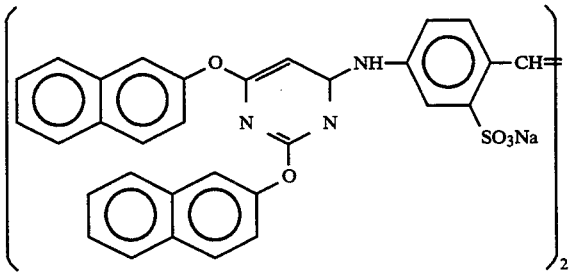

Preservability improver (VI)

-continued

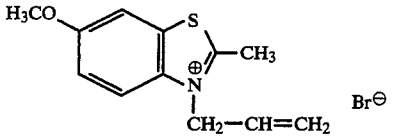

3. Preparation of dye emulsion dispersion 10 kg of Compound 8 as described in JP-A-2-2074, page 4, and 10 kg of Dye No. 4 as described in JP-A-3-231738, page 3, respectively were measured out as an antihalation dye for infrared semiconductor laser and a Color tone adjusting dye. These dyes were each dissolved in a solvent made of a mixture of 12 l of tricresyl phosphate and 85 l of ethyl acetate at a temperature of 55° C. These solutions will be hereinafter referred to as "oil solutions". On the other hand, 1.35 kg of an anionic surface active agent (W-1) was dissolved in 270 ml of a 9.3% aqueous solution of gelatin at a temperature of 45° C. This solution will be hereinafter referred to as "aqueous solution".

These oil solutions were each added into a dispersion vessel with the aqueous solution. The material was subjected to dispersion with the solution temperature being controlled to 40° C. while a dispersing high speed rotary propellor in the vessel being rotated at 6,500 rpm and the pressure in the vessel being gradually reduced from 760 mmHg to 100 mmHg in 60 minutes. The material was further subjected to dispersion for 20 minutes under the same conditions. To the dispersion thus obtained were then added the following additive (a), 1.2 l of a 35% methanol solution of phenoxy ethanol, and water to make 240 kg. The material was cooled for solidification.

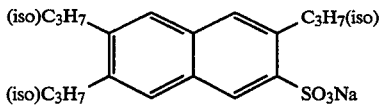

(W-1)

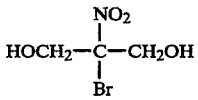

(a)

The area-average grain diameter of grains in the dispersion thus obtained all fell within the range of 0.08 to 0.10 μm.

The emulsion dispersions thus obtained will be hereinafter referred to as "AH-8 (antihalation dye emulsion dispersion)" and "S-6 (color tone adjusting dye emulsion dispersion)", respectively.

4. Preparation of a back layer coating solution

The following additives were added into a vessel which had been heated to a temperature of 40° C. in accordance with the following formulation to prepare a back layer coating solution:

(Antihalation dye-containing back layer coating solution formulations (1) to (5))

| | | |
|---|---|---|
| a. | Gelatin | 80 g |
| b. | Antihalation dye emulsion dispersion AH-8 | |
| | (1) (2) (3) (4) (5) | |
| | 18 g 24 g 27 g 30 g 42 g | |
| c. | Color tone adjusting dye emulsion dispersion S-6 | 1.0 g |
| d. | Sodium polystyrenesulfonate | 0.6 g |
| e. | Poly(ethyl acrylate/methacrylic acid) latex | 15 g |
| f. | N,N'-ethylenebis-(vinylsulfonacetamide) | 5.0 g |

(Back layer coating solution formulation (6))

Same as back layer coating solution formulation (1), except that 18 g of the antihalation dye emulsion was replaced by 0.8 g of Dye (AHS-101)

(Back layer coating solution formulations (7) to (11))

Same as back layer coating solution formulations (1) to (5), except that the color tone adjusting dye emulsion dispersion S-6 was excluded.

(Back layer coating solution formulations (12) to (20))

Back layer coating solution formulation

| | | | | | | | | |
|---|---|---|---|---|---|---|---|---|
| a. Gelatin | | | | | | | | 80 g |
| b. Antihalation dye emulsion dispersion AH-8 | | | | | | | | |
| (12) | (13) | (14) | (15) | (16) | (17) | (18) | (19) | (20) |
| 12 g | 18 g | 60 g | 60 g | 48 g | 0 g | 6 g | 60 g | 6 g |
| c. Color tone adjusting dye emulsion dispersion S-6 | | | | | | | | |
| (12) | (13) | (14) | (15) | (16) | (17) | (18) | (19) | (20) |
| 0 g | 4 g | 0 g | 2.4 g | 1 g | 0 g | 0 g | 5.3 g | 1.7 g |
| d. Dye (AHS-101) | | | | | | | | |
| (12) | (13) | (14) | (15) | (16) | (17) | (18) | (19) | (20) |
| 0.4 g | 0.2 g | 0 g | 0 g | 0.4 g | 2 g | 0.6 g | 0 g | 0.4 g |
| e. Sodium polystyrenesulfonate | | | | | | | | 0.6 g |
| f. Poly(ethyl acrylate/methacrylic acid) latex | | | | | | | | 15 g |
| g. N,N'-ethylenebis-(vinylsulfonacetamide) | | | | | | | | 5.0 g |

Dye (AHS-101)

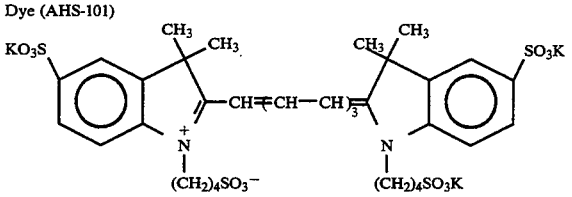

5. Preparation of back surface protective layer coating solution

The following additives were added into a vessel which had been heated to a temperature of 40° C. in accordance with the following formulation to prepare a coating solution:

| (Back surface protective layer coating solution formulation) | | |
|---|---|---|
| a. | Gelatin | 80 g |
| b. | Sodium polystyrenesulfonate | 0.3 g |
| c. | N,N'-ethylenebis-(vinylsulfonacetamide) | 1.7 g |
| d. | Finely divided polymethyl methacrylate grains (average grain size: 4.0 μm) | 4 g |
| e. | Sodium t-octylphenoxyethoxyethanesulfonate | 3.6 g |
| f. | 1N NaOH | 6 ml |
| g. | Sodium polyacrylate | 2 g |
| h. | $C_{16}H_{33}O—(CH_2CH_2O)_{10}—H$ | 3.6 g |
| i. | $C_8F_{17}SO_3K$ | 50 mg |
| j. | $C_8F_{17}SO_2N(C_3H_7)(CH_2CH_2O)_4(CH_2)_4—SO_3Na$ | 50 mg |
| k. | Methanol | 130 ml |

6. Preparation of a coat specimen

The aforementioned back layer coating solutions (1) to (20) were each coated on one side of a transparent polyethylene terephthalate support with 1 g/m$^2$ of the back surface protective layer coating solution in such an amount that the total coated amount of gelatin reached 3.5 g/m$^2$. Subsequently, on the other side of the support were each coated the aforementioned emulsion coating solutions with the surface protective layer coating solution in such an amount that the coated amount of silver reached 2.5 g/m$^2$ and the coated amount of gelatin in the surface protective layer reached 1 g/m$^2$. Thus, coat specimens (1) to (20) were prepared under the following conditions:

The coated amount of N,N'-ethylenebis-(vinylsulfonacetamide) as a film hardener was adjusted to 2.6 % based on the total coated amount of gelatin.

The transmission density of the back layer and the base in combination was measured by means of a spectral absorption meter Type U-3210 available from Hitachi, Ltd. without any reference.

7. Sensitometry

Specimens (1) to (20) thus prepared were allowed to stand under the conditions of 25° C. and 60% RH for 7 days after coating, and then each slit into 25.7 cm×36.4 cm strips. These specimens were each exposed to light by means of a 780 nm infrared semiconductor laser scanner (CR-LP414) for FCR7000 available from Fuji Photo Film Co., Ltd. In the automatic development procedure, the conveying rate was doubled by changing the gear head in the automatic development zone in the scanner CR-LP414.

In the rate doubled version of CR-LP414, the duration between the moment at which the forward edge of the photographic material comes into the automatic processor and the moment at which the forward edge of the photographic material which has been processed comes out from the automatic processor (so-called "top-to-top") is 33.4 seconds. The specifications of the remodelled version of CR-LP414 will be given below.

-continued

| | |
|---|---|
| Drying: | 10.6 sec. |
| Total: | 33.4 sec. |

In order to prepare the developer and fixing solution, the developer and fixing solution in CE-DF.1 kit available from Fuji Photo Film Co., Ltd. were each diluted to obtain 15 l of each solution. 300 ml. of RD-III starter commercially available from Fuji Photo Film Co., Ltd. was added to the developer alone. The temperature of the developer and fixing solution were adjusted to 35° C.±0.2° C. and 32° C.±0.2° C., respectively.

If the film does not exhibit sufficient antihalation effect, Type CR-LP414 laser scanner, which is a flat bed type scanner having sensor holes in the scanning zone (laser exposure zone), causes the sensor holes to appear in marks on the film due to reflected laser beam. The degree of residual color in the film was compared between 5° C. washing water and 32° C. washing water.

For the measurement of sharpness, an SMPTE chart was input through a pattern generator Connected to Type CR-LP414 scanner to make an imagewise exposure on the film. The film thus imagewise exposed was evaluated for sharpness.

8. Evaluation of troubles due to transfer of antihalation dye

The aforementioned specimens (1) to (20) were each subjected to continuous processing under the following conditions. The extent of troubles caused by the transfer of antihalation dye stains on the roller in the drying zone to the photographic material was then evaluated.

TABLE 1

| | Processing Conditions | | | | | | |
|---|---|---|---|---|---|---|---|
| | A | B | C | D | E | F | G |
| Automatic processor | CR-LP 414 | CR-LP 414 | CR-LP 414 | CR-LP 414 double rate | CR-LP 414 double rate | CR-LP 414 double rate | CR-LP 414 |
| Developer | RD-10 | RD-10 | RD-10 | CED-1 | CED-1 | CED-1 | RD-10 |
| Replenishment rate of developer (ml/m$^2$ of photographic material | 590 | 380 | 275 | 535 | 325 | 275 | 275 |
| Fixing solution | RF-10 | RF-10 | RF-10 | CEF-1 | CEF-1 | CEF-1 | RF-10 |
| Replenishment rate of fixing solution | 590 | 380 | 275 | 535 | 325 | 275 | 275 |
| Amount of washing water (l/min.) | 3.2 | 3.0 | 3.0 | 3.0 | 3.0 | 3.0 | 1.5 |

| | |
|---|---|
| Insertion: | 1.1 sec. |
| Development: | 5.45 sec. (in solution) |
| | 1.7 sec. (out of solution) |
| Fixing: | 5.2 sec. (in solution) |
| | 2.4 sec. (out of solution) |
| Rinse: | 4.6 sec. |
| Squeeze: | 2.35 sec. |

The results of these evaluations are set forth in Table 2.

Evaluation of each items shown in Table 2 was carried out visually. The numerals 1 to 12 means superior preformance in this order. That is, numeral 1 means the best performace and numeral 12 means the worst performance. Numeral 9 means allowable limit for practical use.

TABLE 2

| | Specimen No. | | | | |
|---|---|---|---|---|---|
| Evaluation item | (1) | (2) | (3) | (4) | (5) |
| Extent of uneven residual color (washing water temp. 5° C.) | 2 | 2 | 2 | 2 | 2 |
| Color tone difference due to washing water temperature difference (comparison between 5° C. and 32° C.) | 2 | 2 | 2 | 2 | 2 |
| Blue color evaluation upon observation of specimen processed by automatic processor (clear base) | 4 | 3 | 3 | 3 | 2 |
| (Optical density by Macbeth TD904 transmission densitometer except support density) | (0.09) | (0.10) | (0.11) | (0.12) | (0.14) |
| Sharpness evaluation by SMPTE chart | 10 | 4 | 3 | 2 | 2 |
| 780 nm spectral absorption density (before processed) | 0.31 | 0.41 | 0.46 | 0.51 | 0.71 |
| 780 nm spectral absorption density (after processed) | 0.31 | 0.41 | 0.46 | 0.51 | 0.71 |
| Extent of marks of sensor holes in scanner zone of CR-LP414 | 10 | 8 | 4 | 3 | 2 |

TABLE 2-continued

| | | | | | |
|---|---|---|---|---|---|
| | Impracticable | Slight, but practicable | Slight | Little or none | None |
| Extent of fogging due to film detecting electro-optical switch from back surface (Sharp GL520 type light emitting diode-built-in electro-optical, switch) | 9 | 8 | 7 | 6 | 4 |
| Trouble due to transfer of antihalation dye Processing | | | | | |
| A | 2 | 2 | 2 | 2 | 2 |
| B | 2 | 2 | 2 | 2 | 2 |
| C | 2 | 2 | 2 | 2 | 2 |
| D | 2 | 2 | 2 | 2 | 2 |
| E | 2 | 2 | 2 | 2 | 2 |
| F | 2 | 2 | 2 | 2 | 2 |
| G | 2 | 2 | 2 | 2 | 2 |
| Remarks | Comparative | Present Invention | Present Invention | Present Invention | Present Invention |

| | Specimen No. | | | | |
|---|---|---|---|---|---|
| Evaluation item | (6) | (7) | (8) | (9) | (10) |
| Extent of uneven residual color (washing water temp. 5° C.) | 10 | 2 | 2 | 2 | 2 |
| Color tone difference due to washing water temperature difference (comparison between 5° C. and 32° C.) | 11 | 2 | 2 | 2 | 2 |
| Blue color evaluation upon observation of specimen processed by automatic processor (clear base) | 10 Immeasurable due to unevenness | 8 | 5 | 5 | 4 |
| (Optical density by Macbeth TD904 transmission densitometer except support density) | (—) | (0.04) | (0.05) | (0.06) | (0.07) |
| Sharpness evaluation by SMPTE chart | 4 | 10 | 4 | 3 | 2 |
| 780 nm spectral absorption density (before processed) | 0.40 | 0.30 | 0.40 | 0.45 | 0.50 |
| 780 nm spectral absorption density (after processed) | Immeasurable due to unevenness | 0.30 | 0.40 | 0.45 | 0.50 |
| Extent of marks of sensor holes in scanner zone of CR-LP414 | 8 Slight, but practicable | 10 Impracticable | 8 Slight, but practicable | 4 Slight | 3 Little or none |
| Extent of fogging due to film detecting electro-optical switch from back surface (Sharp GL520 type light emitting diode-built-in electro-optical, switch) | 8 | 6 | 8 | 7 | 6 |
| Trouble due to transfer of antihalation dye Processing | | | | | |
| A | 4 | 2 | 2 | 2 | 2 |
| B | 8~10 | 2 | 2 | 2 | 2 |
| C | 10 | 2 | 2 | 2 | 2 |
| D | 5 | 2 | 2 | 2 | 2 |
| E | 8~10 | 2 | 2 | 2 | 2 |
| F | 11 | 2 | 2 | 2 | 2 |
| G | 12 | 2 | 2 | 2 | 2 |
| Remarks | Comparative | Comparative | Present Invention | Present Invention | Present Invention |

| | Specimen No. | | | | |
|---|---|---|---|---|---|
| Evaluation item | (11) | (12) | (13) | (14) | (15) |
| Extent of uneven residual color (washing water temp. 5° C.) | 2 | 4 | 3 | 2 | 2 |
| Color tone difference due to washing water temperature difference (comparison between 5° C. and 32° C.) | 2 | 8 | 4 | 2 | 2 |
| Blue color evaluation upon observation of specimen processed by automatic processor (clear base) | 4 | 8–4 | 4 | 2 | 8 |
| (Optical density by Macbeth TD904 transmission densitometer except support density) | (0.09) | (0.025) Too light blue | (0.24) Too strong blue | (0.135) | (0.30) Too strong blue |
| Sharpness evaluation by SMPTE chart | 2 | 4 | 4 | 1 | 1 |
| 780 nm spectral absorption density (before processed) | 0.70 | 0.4 | 0.44 | 1.00 | 1.02 |
| 780 nm spectral absorption density (after processed) | 0.70 | 0.2 | 0.34 | 1.00 | 1.02 |
| Extent of marks of sensor holes in scanner zone of CR-LP414 | 2 None | 8 Slight, but practicable | 4 Slight | 2 None | 2 None |
| Extent of fogging due to film detecting electro-opticalB4 switch from back surface (Sharp GL520 type light emitting diode-built-in electro-optical, switch) | 4 | 7 | 2 | 2 | 2 |
| Trouble due to transfer of antihalation dye Processing | | | | | |
| A | 2 | 2 | 2 | 2 | 2 |
| B | 2 | 2 | 2 | 2 | 2 |
| C | 2 | 3 | 2 | 2 | 2 |
| D | 2 | 2 | 2 | 2 | 2 |
| E | 2 | 2 | 2 | 2 | 2 |
| F | 2 | 3 | 2 | 2 | 2 |
| G | 2 | 4 | 3 | 2 | 2 |
| Remarks | Present Invention | Present Invention | Present Invention | Present Invention | Present Invention |

| | Specimen No. | | | | |
|---|---|---|---|---|---|
| Evaluation item | (16) | (17) | (18) | (19) | (20) |
| Extent of uneven residual color (washing water temp. 5° C.) | 4 | 11 | 8 | 2 | 4 |

TABLE 2-continued

| | | | | | |
|---|---|---|---|---|---|
| Color tone difference due to washing water temperature difference (comparison between 5° C. and 32° C.) | 8 | 12 | 10 | 2 | 8 |
| Blue color evaluation upon observation of specimen processed by automatic processor (clear base) | 2 | Immeasurable due to unevenness | 10 | 10 | 3 |
| (Optical density by Macbeth TD904 transmission densitometer except support density) | (0.15) | (—) | (0.01) Too light blue | (0.40) Too strong blue, impracticable | (0.10) |
| Sharpness evaluation by SMPTE chart | 1 | 1 | 4 | 1 | 10 |
| 780 nm spectral absorption density (before processed) | 1.01 | 1.00 | 0.40 | 1.05 | 0.32 |
| 780 nm spectral absorption density (after processed) | 0.81 | Immeasurable due to unevenness | 0.10 | 1.05 | 0.12 |
| Extent of marks of sensor holes in scanner zone of CR-LP414 | 2 None | 2 None | 8 Slight, but practicable | 2 None | 10 Impracticable |
| Extent of fogging due to film detecting electro-optical switch from back surface (Sharp GL520 type light emitting diode-built-in electro-optical, switch) | 2 | 2 | 8 | 2 | 9 |
| Trouble due to transfer of antihalation dye Processing | | | | | |
| A | 2 | 4 | 3 | 2 | 2 |
| B | 2 | 8~10 | 3 | 2 | 2 |
| C | 3 | 10 | 4 | 2 | 3 |
| D | 2 | 8 | 3 | 2 | 2 |
| E | 2 | 8~10 | 3 | 2 | 2 |
| F | 3 | 11 | 4 | 2 | 3 |
| G | 4 | 12 | 5 | 2 | 4 |
| Remarks | Present Invention | Comparative | Comparative | Present Invention | Comparative |

It can be seen from the above results that the photographic materials according to the present invention exhibit less residual color, less tone difference, good sharpness, no problem with respect to extent of marks of sensor holes, and no trouble due to transfer of the antihalation dye under any condition of processing.

While the invention has been described in detail and with reference to specific embodiments thereof, it will be apparent to one skilled in the art that various changes and modifications can be made therein Without departing from the spirit and scope thereof.

What is claimed is:

1. A silver halide photographic material for laser exposure comprising at least one silver halide emulsion layer on a support, wherein said support or photographic constituent layers of said material contain an antihalation dye which exhibits a spectral absorption density of 0.4 or more before development with respect to the wavelength corresponding to the laser to be used for exposure and a spectral absorption density of 0.2 or more after development when the fluctuations of the average visual density excluding the support density and emulsion fog density are 0.02 or less, wherein when the fluctuations of the average visual density, excluding the support density and the emulsion fog density, are 0.02 or less after development, the unexposed portion of said material has a blue density in the range of 0.04 to 0.30 as calculated in terms of average visual density excluding the support density and the density of dyes other than antihalation dye in the layers constituting the photographic material, and wherein said photographic material comprises at least one infrared-sensitive silver halide emulsion layer and at least one layer containing an emulsion obtained by dissolving a hydrophobic dye having an absorption maximum from 570 nm to 700 nm in the light wavelength range visible by the human eyes in a slightly water-soluble or water-insoluble organic solvent, followed by emulsifying and dispersing.

2. The silver halide photographic material for laser exposure according to claim 1, wherein said antihalation dye exhibits a spectral absorption density of 0.5 or more before development with respect to the wavelength corresponding to the laser used.

3. The silver halide photographic material for laser exposure according to claim 1, wherein the difference in the spectral absorption density with respect to the wavelength of laser to be used for exposure between before and after the development of the photographic material is less than 0.4.

4. A silver halide photographic material for laser exposure comprising at least one silver halide emulsion layer on a support, wherein said support or photographic constituent layers contain an antihalation dye having a spectral absorption in the wavelength range of 780 nm or less which exhibits a spectral absorption density of 0.4 or more before development with respect to the wavelength corresponding to the laser used, wherein when fluctuations of the average visual density, excluding the support density and the emulsion fog density, are 0.02 or less after development, the spectral absorption density is 0.2 or more after development, the unexposed portion of said material has a blue density in the range of 0.04 to 0.30 as calculated in terms of average visual density excluding the support density and the density of dyes other than antihalation dye in the layers constituting the photographic material, and wherein said photographic material comprises at least one infrared-sensitive silver halide emulsion layer and at least one layer containing an emulsion obtained by dissolving a hydrophobic dye having an absorption maximum from 570 nm to 700 nm in the light wavelength range visible by the human eyes in a slightly water-soluble or water-insoluble organic solvent, followed by emulsifying and dispersing.

* * * * *